US009149103B2

(12) United States Patent
Yoe

(10) Patent No.: US 9,149,103 B2
(45) Date of Patent: Oct. 6, 2015

(54) WIND-COLLECTING NOZZLE MOUNTED ON OUTLET OF HAIR DRYER

(71) Applicant: Han Hian Yoe, Shenzhen (CN)

(72) Inventor: Han Hian Yoe, Shenzhen (CN)

( * ) Notice: Subject to any disclaimer, the term of this patent is extended or adjusted under 35 U.S.C. 154(b) by 434 days.

(21) Appl. No.: 13/679,998

(22) Filed: Nov. 16, 2012

(65) Prior Publication Data

US 2013/0074356 A1 Mar. 28, 2013

Related U.S. Application Data

(63) Continuation-in-part of application No. 12/737,575, filed as application No. PCT/CN2010/071084 on Mar. 16, 2010, now abandoned.

(30) Foreign Application Priority Data

Mar. 24, 2009 (CN) ..... 2009 2 0135833

(51) Int. Cl.

| | |
|---|---|
| ***A45D 20/12*** | (2006.01) |
| ***A45D 20/00*** | (2006.01) |
| *B05B 1/14* | (2006.01) |
| *B05B 1/04* | (2006.01) |

(52) U.S. Cl.

CPC ..... *A45D 20/00* (2013.01); *A45D 20/124* (2013.01); *B05B 1/044* (2013.01); *B05B 1/14* (2013.01)

(58) Field of Classification Search

CPC ..... A45D 20/00; A45D 20/12; A45D 20/122; A45D 20/124; B05B 1/044; B05B 1/048; B05B 1/14

USPC ..... 239/505, 506, 518, 548, 550, 551, 565; 34/96–101

See application file for complete search history.

(56) References Cited

U.S. PATENT DOCUMENTS 1,650,136 A * 11/1927 Koberle ..... 239/543
1,685,345 A * 9/1928 Voss ..... 34/99

* cited by examiner

*Primary Examiner* — Christopher Kim
(74) *Attorney, Agent, or Firm* — Novoclaims Patent Services LLC; Mei Lin Wong

(57) ABSTRACT

An air dryer includes a dryer body, a wind-collecting nozzle mounted in front of the dryer body. The wind-collecting nozzle includes a wind-collecting nozzle body communicated with the dryer body, and has a plurality of air openings spacedly formed thereon. Two blowing pieces are supported by the wind-collecting nozzle body, wherein each of the blowing pieces has a blowing outlet. Moreover, a plurality of connecting rims is mounted between the blowing pieces and the wind-collecting nozzle body at the air openings respectively for rotatably connecting the blowing pieces with the wind-collecting nozzle body, so that the air dryer is capable of delivering air at a predetermined orientation through the air openings and the blowing outlets.

14 Claims, 5 Drawing Sheets

WIND-COLLECTING NOZZLE MOUNTED ON OUTLET OF HAIR DRYER

CROSS REFERENCE OF RELATED APPLICATION

This is a Continuation-In-Part application of a non-provisional application having an application Ser. No. 12/737,575, and a filing date of Jan. 26, 2011, which is a national phase national application of an international patent application number PCT/CN2010/071084 with a filing date of Mar. 16, 2010 based on a foreign application number 200920135833.3 with a filing date of Mar. 24, 2009 in China. The contents of these specifications, including any intervening amendments thereto, are incorporated herein by reference.

BACKGROUND OF THE PRESENT INVENTION

1. Field of Invention

The present invention relates to the technical field of hairdressing tool, and more particularly to a wind-collecting nozzle mounted on the outlet of dryer.

2. Description of Related Arts

Currently, after washing the hair, people simply use towels to wipe the hair and let the hair dry naturally. However, in order to dry the hair quickly, a dryer (hairdryer) may be used to dry the hair. Hence, the dryer becomes a very important hairdressing tool in people's living. As the dryer could produce hot air with various temperatures, it can thus be generally applied to various applications. For example, people feed pets and some pets have very long and thick hair, such as the dogs that its hair will get very wet after bathing. It is required to dry its hair and people generally use the dryer for drying it. However, the current dryer generally has installed a wind-collecting nozzle having a flat blowing outlet or a round blowing outlet which fails to provide an ideal effect of quick-drying and a convenient operation.

SUMMARY OF THE PRESENT INVENTION

An objective of the present invention is to provide a wind-collecting nozzle mounted on a dryer for enhancing the quick-drying effect of the dryer.

Another objective of the present invention is to provide a wind-collecting nozzle which is capable of being adjusted according to different situations so as to achieve a most effective dryer with the fastest drying ability.

In view of the above objectives, the present invention provides a wind-collecting nozzle mounted on an outlet of a dryer, wherein the wind-collecting nozzle comprises a wind-collecting nozzle body having at least two blowing ports.

In order to accomplish the above objects, the present invention provides an air dryer, comprising:

a dryer body;

a wind-collecting nozzle mounted in front of said dryer body, and comprises:

a wind-collecting nozzle body communicated with said dryer body, and has a plurality of air openings spacedly formed thereon;

two blowing pieces supported by said wind-collecting nozzle body, wherein each of said blowing pieces has a blowing outlet; and a plurality of plug-and-pull connectors mounted between said blowing pieces and said wind-collecting nozzle body at said air openings respectively for rotatably connecting said blowing pieces with said wind-collecting nozzle body, so that said air dryer is capable of delivering air at a predetermined orientation through said air openings and said blowing outlets.

Each of the connecting rims has a partitioning wall peripherally protruded from a side wall of the connecting rim to divide the connecting rim into a front portion and a rear portion, wherein the front portion is connected to the corresponding blowing piece, while the rear portion is rotatably connected to the wind-collecting nozzle body.

The wind-collecting nozzle body has a plurality of protruding elements formed around an inner side thereof, wherein each of the connecting rims has a ring shaped groove provided thereon for receiving the protruding elements therein respectively so as to enable the blowing pieces rotating about the respective protruding element.

Each of the blowing pieces has a body portion having an inner end mounted on the wind-collecting nozzle body, and an outlet portion, wherein the body portion has a substantially circular cross section and a diameter thereof is gradually decreasing from the wind-collecting nozzle body to the outlet portion so as to form a tapered shape of the corresponding blowing piece.

Each of the outlet portions is formed at an outer end of the corresponding body portion, wherein the blowing outlet is formed on the outlet portion, so that air is arranged to be delivered to an exterior of the air dryer through the blowing outlet.

On the other hand, the blowing pieces are spacedly mounted in front of the wind-collecting nozzle body in a parallel manner such that longitudinal axes of the blowing pieces point toward a same orientation.

The wind-collecting nozzle body has a cross section surface area which is substantially greater than that of the dryer body so as to accommodate the blowing pieces at a front end portion thereof for evenly and spacedly distributing the air flow generated from the dryer body.

Moreover, the wind-collecting nozzle further comprises a plug-and-pull connector mounted on the wind collecting nozzle body to connect to the dryer body, wherein the plug-and-pull connector has a ring-shaped cross section wherein a plurality of connecting grooves is peripherally formed thereon for connecting with a front opening of the dryer body.

The dryer body has a handle portion and a blower portion transversely extended from the handle portion, wherein a user is able to hold the handle portion and dry an object by pointing the wind-collecting nozzle toward the object.

DETAILED DESCRIPTION OF THE PREFERRED EMBODIMENT

Figure 1:
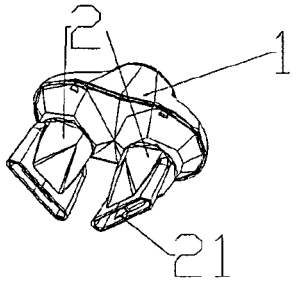
FIG. 1 is a perspective view of a wind-collecting nozzle mounted on the outlet of a dryer according to a first preferred embodiment of the present invention.
Figure 2:
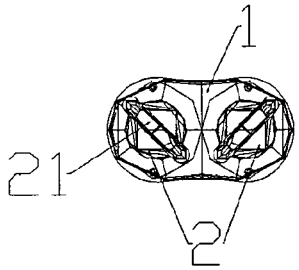
FIG. 2 is a side view of FIG. 1.
Figure 3:
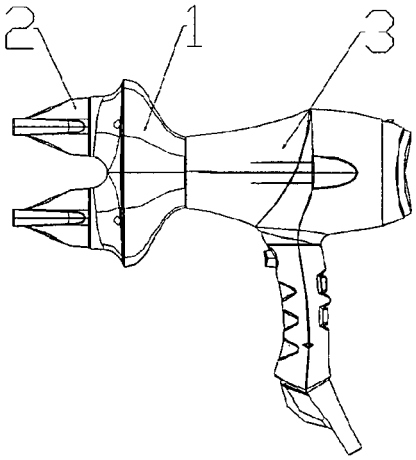
FIG. 3 is a structural view of the wind-collecting nozzle mounted on the outlet of the dryer according to the first preferred embodiment of the present invention.
Figure 4:
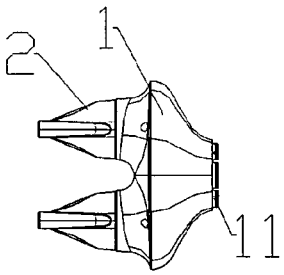
FIG. 4 is a front view of the wind-collecting nozzle mounted on the outlet of the dryer according to the first preferred embodiment of the present invention.
Figure 5:
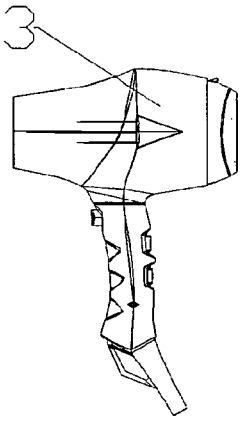
FIG. 5 is a front view of the dryer of the first preferred embodiment of the present invention.

The wind-collecting nozzle mounted on the outlet of the dryer of the present invention is further described as follows with the reference to the drawings.

Referring to FIGS. 1-4 of the drawings, the present invention provides a wind-collecting nozzle for mounting on the outlet of a dryer, wherein the wind-collecting nozzle comprises a wind-collecting nozzle body 1. The wind-collecting nozzle body 1 comprises an plug-and-pull connector 11 provided at first end thereof for mounting on the outlet of the dryer 3 and two spacedly disposed mounting ports provided at a second end thereof, wherein each mounting port has a blowing piece 2 having a flat shaped blowing outlet 21 formed at a the free end thereof.

Each mounting port of the wind-collecting nozzle body 1 is circular shaped port which has a protruding element formed around the inner side thereof. Each blowing piece 2 has a circular shaped opening provided at a mounting end thereof where a ring shaped groove is provided therein for receiving the protruding element therein so as to enable the blowing piece rotating about the respective protruding element. When using, the two blowing outlets, each being embodied to have a flat shape, of the wind barrel 2 are preferably adjusted to in a predetermined configuration to achieve the most effective and fastest drying ability.

The plug-and-pull connector 11 of the wind-collecting nozzle body 1 is embodied as a circular groove with positioning holes formed therein. Preferably, the wind-collecting nozzle body 1 has a plurality of mounting ports and the blowing pieces 2 and the wind-collecting body 1 could be made integrally with the two flat shaped blowing outlets to be arranged in a predetermined configuration.

Referring to FIG. 6 to FIG. 9 of the drawings, an air dryer according to a second preferred embodiment of the present invention is illustrated, in which the air dryer comprises a dryer body 10', and a wind-collecting nozzle 20' which is mounted in front of the dryer body 10', and comprises a wind-collecting nozzle body 1', two blowing pieces 2', and a plurality of connecting rims 12'.

The wind-collecting nozzle body 1' is communicated with the dryer body 10', and has a plurality of air openings 15' spacedly formed thereon.

The two blowing pieces 2' are supported by the wind-collecting nozzle body 1', wherein each of the blowing pieces 2' has a blowing outlet 211'.

The plurality of connecting rims 12' is mounted between the blowing pieces 2' and the wind-collecting nozzle body 1' at the air openings 15' respectively for rotatably connecting the blowing pieces 2' with the wind-collecting nozzle body 1', so that the air dryer is capable of delivering air at a predetermined orientation through the air openings 15' and the blowing outlets 211'.

In the second preferred embodiment, the dryer body 10' is embodied as a conventional dryer body having a receiving cavity formed thereon and is equipped with a blowing device, such as a blowing fan, electrically connected to an external power source for generating accelerated air flow toward the wind-collecting nozzle 20'. The dryer body 10' has a handle portion 101' and a blower portion 12' transversely extended from the handle portion 101'. A user is able to hold the handle portion 101' and dry his or her hair by pointing the wind-collecting nozzle 20' toward his or her head.

A cross sectional surface area of the wind-collecting nozzle body 1' is substantially greater than that of the dryer body 10' so as to accommodate the blowing pieces 2' at a front end portion thereof and to evenly divide the air flow generated from the dryer body 10' into the blowing pieces 2'.

Each of the wind-collecting nozzle body 1' has a plurality of protruding elements 111' formed around an inner side thereof. Each of the connecting rims 12' has a ring shaped groove 121' provided thereon for receiving the protruding elements 111' therein respectively so as to enable the blowing pieces 2' rotating about the respective protruding element 111'.

Moreover, each of the connecting rims 12' has a partitioning wall 122' peripherally protruded from a side wall of the connecting rim 12' to divide the connecting rim 12' into a front portion 123' and a rear portion 124', wherein the front portion 123' is connected to the corresponding blowing piece 2', while the rear portion 124' is rotatably connected to the wind-collecting nozzle body 1'.

Figure 6:
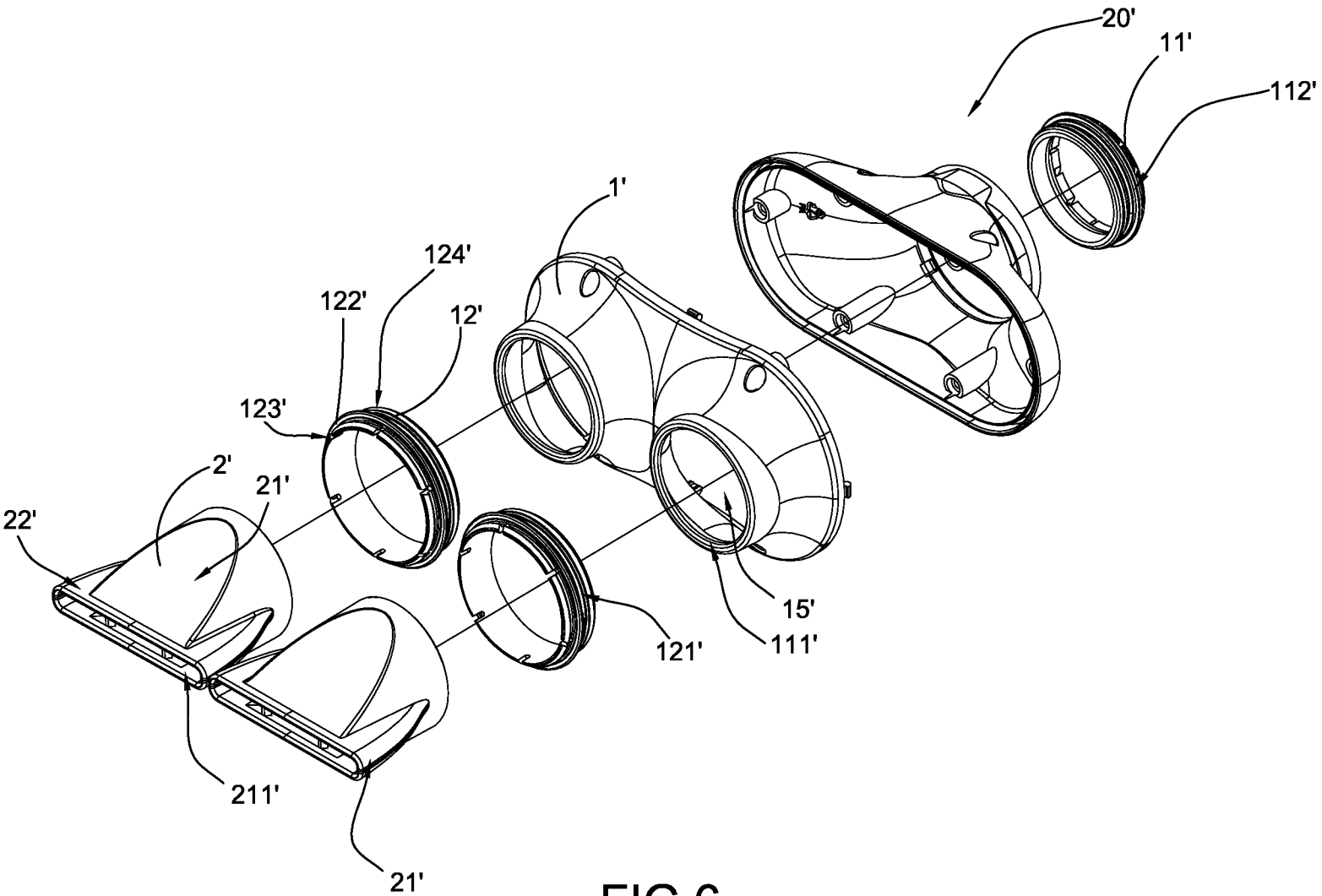
FIG. 6 is an exploded perspective view of the dryer according to a second preferred embodiment of the present invention, illustrating the wind-collecting nozzle.
Figure 7:
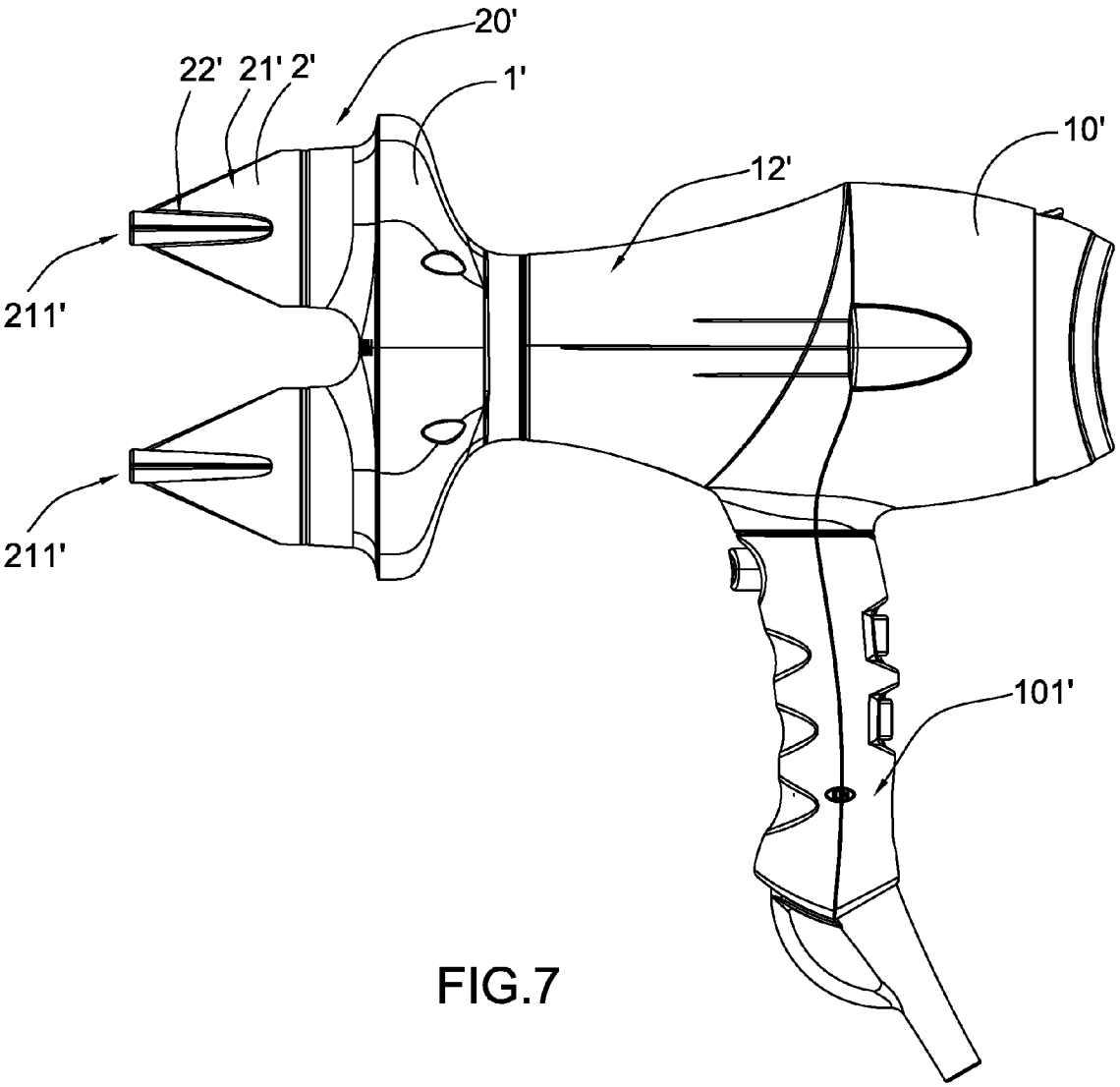
FIG. 7 is a side view of the dryer according to the second preferred embodiment of the present invention.

As shown in FIG. 6 of the drawings, each of the blowing pieces 2' has a body portion 21' having an inner end mounted on the wind-collecting nozzle body 1', and an outlet portion 22', wherein the body portion 21' has a substantially circular cross section and a diameter thereof is gradually decreasing from the wind-collecting nozzle body 1' to the outlet portion 22' so as to form a tapered shape of the corresponding blowing piece 2'. The outlet portion 22' is formed at an outer end of the corresponding body portion 21', wherein the blowing outlet 211' is formed on the outlet portion 22', so that air is arranged to be delivered to an exterior of the air dryer through the blowing outlet 211'.

It is worth mentioning that the blowing pieces 2' are spacedly mounted in front of the wind-collecting nozzle body 1' in a parallel manner such that their longitudinal axis point toward the same direction or orientation. In other words, an object positioned in front of the air dryer is subject to the air flow coming out from the two blowing pieces 2'. Moreover, each of the blowing pieces 2' is capable of rotating with respect to the wind-collecting nozzle body 1'. When the blowing pieces 2' is rotating with respect to the wind-collecting nozzle body 1', the air blown out from the blowing pieces 2' is arranged to generate different blowing effect from the air dryer so as to accomplish different blowing purposes. For example, the two blowing pieces 2' are capable of delivering strong air flow for drying pet's hair. By rotating the blowing pieces 2', the orientation of the air flow can be altered so as to fit different objects which are to be dried.

Figure 8:
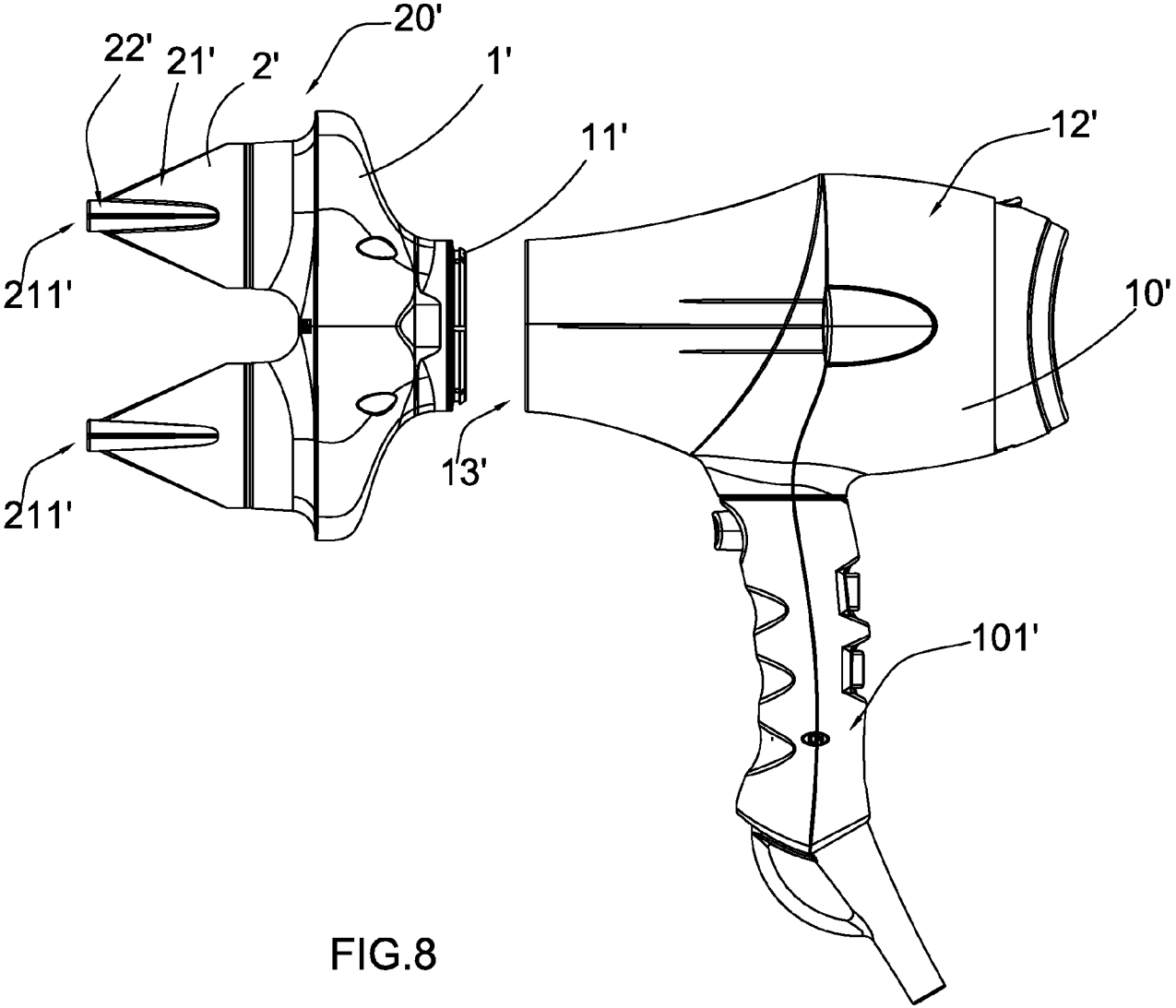
FIG. 8 is a side schematic diagram of the dryer according to the second preferred embodiment of the present invention.
Figure 9:
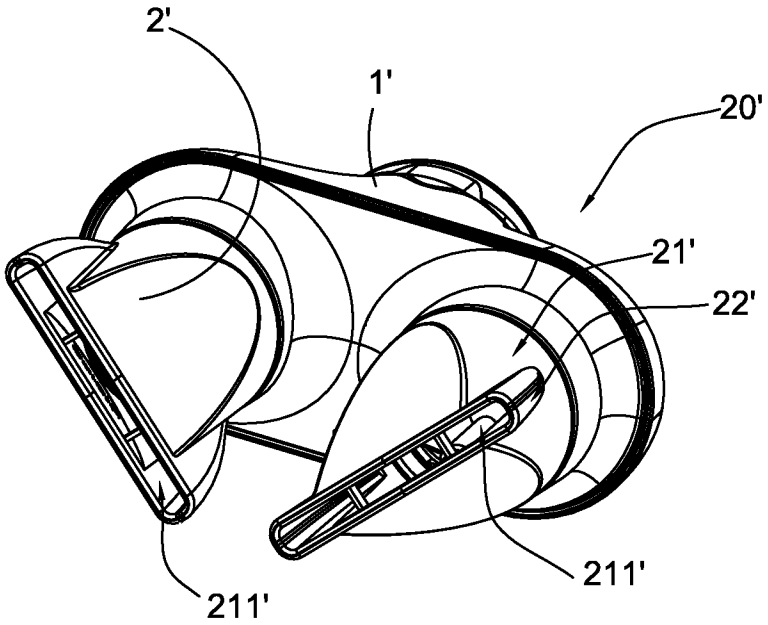
FIG. 9 is a perspective schematic diagram of the dryer according to the second preferred embodiment of the present invention.

Moreover, one having ordinary skill in the art must appreciate that the blowing pieces 2' may be mounted on the wind-collecting nozzle body 1' in different arrangements. For example, they can be mounted in a side-by-side manner, or in an up-and-down manner (as shown in FIG. 8). Furthermore, the blowing pieces 2' may be selectively rotated so that the outlet portions 22' form a predetermined angle of inclination (such as 45 degrees) with respect to each other (as shown in FIG. 9).

The wind-collecting nozzle 20' further comprises a plug-and-pull 11' mounted on the wind collecting nozzle body 1' to connect to the dryer body 10'. As shown in FIG. 6 of the drawings, the plug-and-pull connector 11' is embodied as a ring wherein a plurality of connecting grooves 112' is peripherally formed thereon for connecting with a front opening 13' of the dryer body 10'.

The present invention, while illustrated and described in terms of a preferred embodiment and several alternatives, is not limited to the particular description contained in this specification. Additional alternative or equivalent components could be used to practice the present invention.

What is claimed is:

1. An air dryer, comprising:

a dryer body; and a wind-collecting nozzle mounted in front of said dryer body, and comprises:

a wind-collecting nozzle body communicated with said dryer body, and has two air openings spacedly formed thereon;

two blowing pieces supported by said wind-collecting nozzle body, wherein each of said blowing pieces has a blowing outlet; and two connecting rims mounted between said blowing pieces and said wind-collecting nozzle body at said air openings respectively for rotatably connecting said blowing pieces with said wind-collecting nozzle body, so that said air dryer is capable of delivering air at a predetermined orientation through said air openings and said blowing outlets, wherein each of said connecting rims has a partitioning wall peripherally protruded from a side wall of said connecting rim to divide said connecting rim into a front portion and a rear portion, wherein said front portion is connected to said corresponding blowing piece, while said rear portion is rotatably connected to said wind-collecting nozzle body, wherein said wind-collecting nozzle body has a plurality of protruding elements formed around an inner side thereof, wherein each of said connecting rims has a ring shaped groove provided thereon for receiving said protruding elements therein respectively so as to enable said blowing pieces rotating about said respective protruding element, wherein each of said blowing pieces has a body portion having an inner end mounted on said wind-collecting nozzle body, and an outlet portion, wherein said body portion has a substantially circular cross section and a diameter thereof is gradually decreasing from said wind-collecting nozzle body to said outlet portion so as to form a tapered shape of said corresponding blowing piece.

2. The air dryer, as recited in claim 1, wherein each of said outlet portions is formed at an outer end of said corresponding body portion, wherein said blowing outlet is formed on said outlet portion, so that air is arranged to be delivered to an exterior of said air dryer through said blowing outlet.

3. The air dryer, as recited in claim 2, wherein said blowing pieces are spacedly mounted in front of said wind-collecting nozzle body in a parallel manner such that longitudinal axes of said blowing pieces point toward a same orientation.

4. The air dryer, as recited in claim 3, wherein said wind-collecting nozzle body has a cross section surface area which is substantially greater than that of said dryer body so as to accommodate said blowing pieces at a front end portion thereof for evenly and spacedly distributing said air flow generated from said dryer body.

5. The air dryer, as recited in claim 4, wherein said wind-collecting nozzle further comprises a plug-and-pull connector mounted on said wind collecting nozzle body to connect to said dryer body, wherein said plug-and-pull connector has a ring-shaped cross section wherein a plurality of connecting grooves is peripherally formed thereon for connecting with a front opening of said dryer body.

6. The air dryer, as recited in claim 4, wherein said dryer body has a handle portion and a blower portion transversely extended from said handle portion, wherein a user is able to hold said handle portion and dry an object by pointing said wind-collecting nozzle toward said object.

7. The air dryer, as recited in claim 5, wherein said dryer body has a handle portion and a blower portion transversely extended from said handle portion, wherein a user is able to hold said handle portion and dry an object by pointing said wind-collecting nozzle toward said object.

8. A wind-collecting nozzle for an air dryer having a dryer body, comprising:

a wind-collecting nozzle body communicated with said dryer body, and has two air openings spacedly formed thereon;

two blowing pieces supported by said wind-collecting nozzle body, wherein each of said blowing pieces has a blowing outlet; and two connecting rims mounted between said blowing pieces and said wind-collecting nozzle body at said air openings respectively for rotatably connecting said blowing pieces with said wind-collecting nozzle body, so that said air dryer is capable of delivering air at a predetermined orientation through said air openings and said blowing outlets, wherein each of said connecting rims has a partitioning wall peripherally protruded from a side wall of said connecting rim to divide said connecting rim into a front portion and a rear portion, wherein said front portion is connected to said corresponding blowing piece, while said rear portion is rotatably connected to said wind-collecting nozzle body, wherein said wind-collecting nozzle body has a plurality of protruding elements formed around an inner side thereof, wherein each of said connecting rims has a ring shaped groove provided thereon for receiving said protruding elements therein respectively so as to enable said blowing pieces rotating about said respective protruding element, wherein each of said blowing pieces has a body portion having an inner end mounted on said wind-collecting nozzle body, and an outlet portion, wherein said body portion has a substantially circular cross section and a diameter thereof is gradually decreasing from said wind-collecting nozzle body to said outlet portion so as to form a tapered shape of said corresponding blowing piece.

9. The air dryer, as recited in claim 8, wherein each of said outlet portions is formed at an outer end of said corresponding body portion, wherein said blowing outlet is formed on said outlet portion, so that air is arranged to be delivered to an exterior of said air dryer through said blowing outlet.

10. The air dryer, as recited in claim 9, wherein each of said blowing pieces are spacedly mounted in front of said wind-collecting nozzle body in a parallel manner such that longitudinal axes of said blowing pieces point toward a same orientation.

11. The air dryer, as recited in claim 10, wherein said wind-collecting nozzle body has a cross section surface area which is substantially greater than that of said dryer body so as to accommodate said blowing pieces at a front end portion thereof for evenly and spacedly distributing said air flow generated from said dryer body.

12. The air dryer, as recited in claim 9, wherein said wind-collecting nozzle further comprises a plug-and-pull connector mounted on said wind collecting nozzle body to connect to said dryer body, wherein said plug-and-pull connector has a ring-shaped cross section wherein a plurality of connecting grooves is peripherally formed thereon for connecting with a front opening of said dryer body.

13. The air dryer, as recited in claim 10, wherein said wind-collecting nozzle further comprises a plug-and-pull connector mounted on said wind collecting nozzle body to connect to said dryer body, wherein said plug-and-pull connector has a ring-shaped cross section wherein a plurality of connecting grooves is peripherally formed thereon for connecting with a front opening of said dryer body.

14. The air dryer, as recited in claim 11, wherein said wind-collecting nozzle further comprises a plug-and-pull connector mounted on said wind collecting nozzle body to connect to said dryer body, wherein said plug-and-pull connector has a ring-shaped cross section wherein a plurality of connecting grooves is peripherally formed thereon for connecting with a front opening of said dryer body.

* * * * *